US008177692B2

(12) United States Patent
Deppen

(10) Patent No.: US 8,177,692 B2
(45) Date of Patent: May 15, 2012

(54) PIKE POLE EXERCISE APPARATUS

(76) Inventor: Timothy A. Deppen, Sanford, FL (US)

( * ) Notice: Subject to any disclaimer, the term of this patent is extended or adjusted under 35 U.S.C. 154(b) by 50 days.

(21) Appl. No.: 12/585,761

(22) Filed: Sep. 23, 2009

(65) Prior Publication Data

US 2010/0075815 A1 Mar. 25, 2010

Related U.S. Application Data

(60) Provisional application No. 61/100,201, filed on Sep. 25, 2008.

(51) Int. Cl.
*A63B 21/06* (2006.01)

(52) U.S. Cl. ..... 482/93; 482/98; 434/226

(58) Field of Classification Search ..... 482/33–36, 482/92–101, 77; 434/226, 256; 182/133–136
See application file for complete search history.

(56) References Cited

U.S. PATENT DOCUMENTS

| | | | | | |
|---|---|---|---|---|---|
| 2,723,855 | A * | 11/1955 | McKee | 482/77 |
| 3,957,266 | A * | 5/1976 | Rice | 482/91 |
| 4,208,793 | A | 6/1980 | Sinnott | |
| 4,576,354 | A * | 3/1986 | Blessing, Sr. | 248/354.5 |
| 4,664,373 | A * | 5/1987 | Hait | 482/93 |
| 5,318,058 | A * | 6/1994 | Zimmerman | 135/68 |
| 5,628,713 | A * | 5/1997 | Wilkinson | 482/74 |
| 5,713,819 | A * | 2/1998 | Hsieh | 482/77 |
| 5,820,520 | A * | 10/1998 | Sieber | 482/34 |
| 6,152,858 | A * | 11/2000 | Kolb | 482/44 |
| 6,217,073 | B1 * | 4/2001 | Hoffman | 280/823 |
| 6,352,494 | B2 * | 3/2002 | McAlonan | 482/77 |
| 6,385,854 | B1 | 5/2002 | Sisco | |
| 6,494,817 | B2 * | 12/2002 | Lake | 482/93 |
| 6,503,177 | B2 * | 1/2003 | Herman | 482/77 |
| 7,131,615 | B1 * | 11/2006 | Bruce | 248/127 |
| 7,261,140 | B2 * | 8/2007 | Whittemore | 160/368.1 |
| 7,395,829 | B2 * | 7/2008 | Chapman | 135/82 |
| 7,565,711 | B1 | 7/2009 | Schamadan | |
| 7,712,478 | B2 * | 5/2010 | Gibbons et al. | 135/73 |
| 7,749,142 | B2 * | 7/2010 | Kuhagen | 482/129 |
| 2003/0041385 | A1 * | 3/2003 | Humphreys | 7/145 |
| 2003/0192187 | A1 * | 10/2003 | Bean | 30/164.6 |
| 2005/0176558 | A1 * | 8/2005 | Huang | 482/93 |
| 2007/0023072 | A1 * | 2/2007 | Agnello et al. | 135/65 |
| 2008/0146423 | A1 * | 6/2008 | Ammon et al. | 482/131 |

* cited by examiner

*Primary Examiner* — Loan Thanh
*Assistant Examiner* — Daniel F Roland
(74) *Attorney, Agent, or Firm* — William M. Hobby, III

(57) ABSTRACT

A pike pole exercise apparatus is provided for firemen to train and condition themselves for using a pike pole hook. A base has an elongated post attached thereto which extends generally vertically therefrom. An elongated hollow slide member is slidably mounted on the elongated post for sliding thereon and has a weight attached thereto so that a fireman can grip the slide member and slide it up and down on the elongated pole to exercise and train for using a pike pole hook.

3 Claims, 4 Drawing Sheets

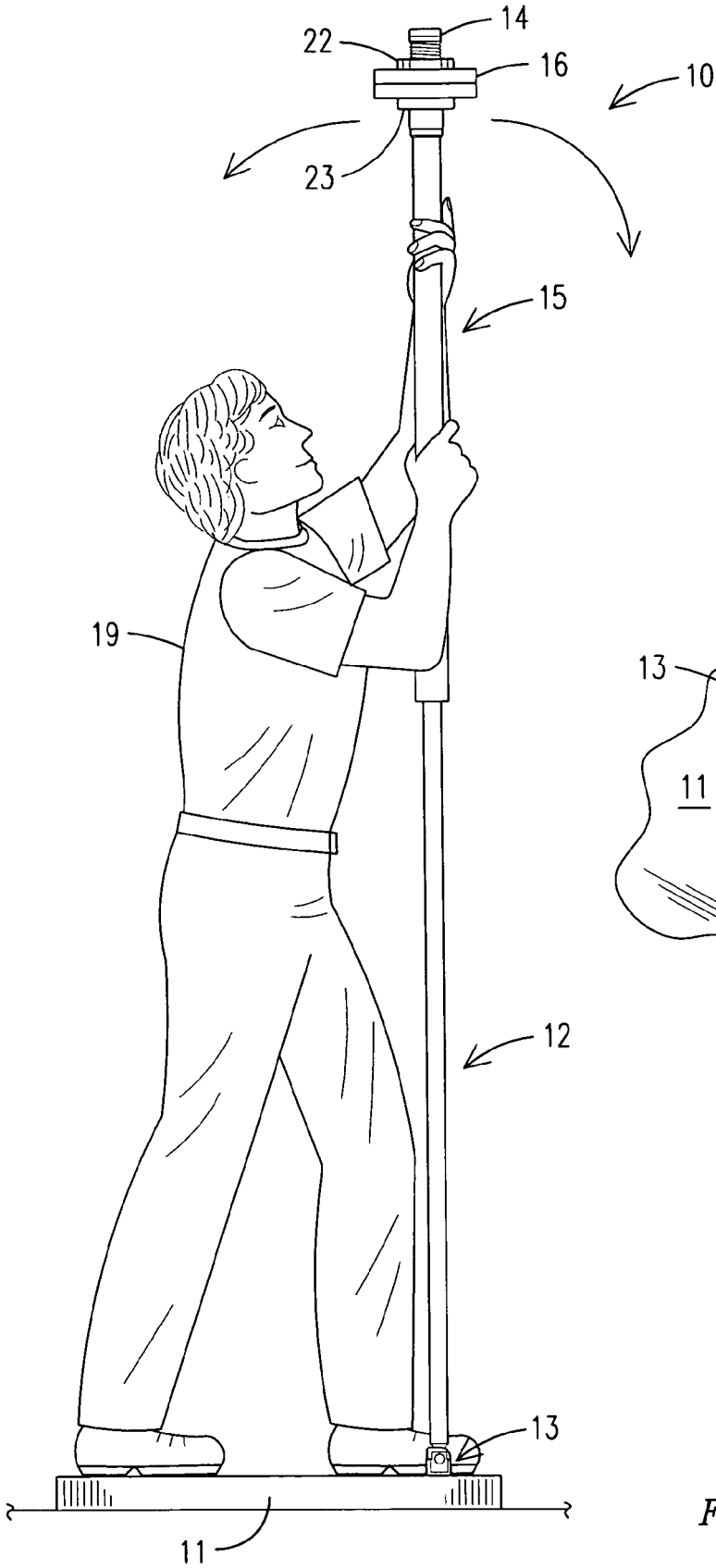
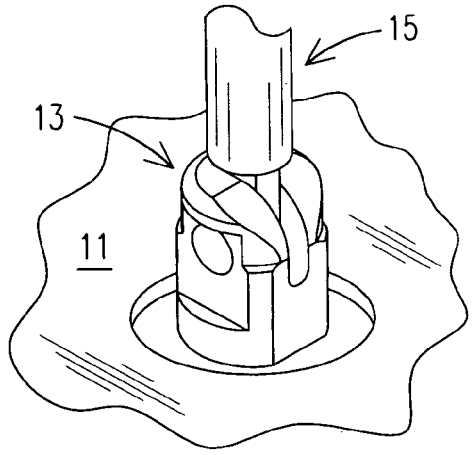
FIG. 4
FIG. 2

PIKE POLE EXERCISE APPARATUS

This application claims the benefit of U.S. Provisional Application No. 61/100,201, filed Sep. 25, 2008.

The present invention relates to a pike pole exercise apparatus and especially to an apparatus for a fireman to exercise and train in the use of a pike pole.

BACKGROUND OF THE INVENTION

Firefighters frequently find it necessary to gain entry through walls and ceilings in emergency situations for breaking away sections of a structure. Firefighters also need to create ventilation openings in structures to vent a fire in the course of performing their duties. These and other operations often require the use of various firefighting tools, such as a pike pole. The pike pole has an elongated shaft or handle with a sharpened piercing end which may be used to create openings in walls or ceilings. A traditional pike pole or pike pole hook also has a hook shaped arm that is spaced inward from the piercing end that may be used to engage walls or ceilings to high pry away sections of the walls or ceilings.

Pike pole type tools may be seen in U.S. Pat. No. 4,208,793 for a fire fighting device used by firemen for the purpose of battering holes in ceilings and walls to expose the fire therein and to apply fire fighting water or chemicals. In the Sisco U.S. Pat. No. 6,385,854 a fire fighting tool for making a hole in the ceiling includes a body, a hook and a handle. In the U.S. Pat. No. 7,565,711 to Schamadan, a combination firefighting tool includes a pike pole having a pike pole hook, as well as other firefighting tools, attached thereto.

The present invention is directed towards an exercise apparatus for firemen to train in the use of a pike pole by conditioning the muscles in the body for vertically lifting a pike pole to push the pike pole hook into the ceiling of a structure. This operation is commonly required by firemen and it is a difficult task in that you have to raise a heavy pole and hook overhead and ram the hook through a ceiling or wall for gouging a hole in the ceiling or wall to gain access to the fire.

SUMMARY OF THE INVENTION

A pike pole exercise apparatus is provided having a base having an elongated post which has a pivot motion but may also swivel. The post is attached to the base and extends generally vertically therefrom. An elongated hollow slide member is slidably mounted on the elongated post for sliding thereon and has a weight attached thereto so that a fireman can grip the slide member and slide it up and down on the elongated pole to train for using a pike pole. The pike pole exerciser has a provision for adding conventional barbell weights for increasing the resistance in the exercise function and has post extensions for extending the post for different size firemen. The elongated post is attached to a base and has a stop member at the top thereof and a resistance member, located near the end thereof, to frictionally engage the hollow slide member to simulate a pike pole hook engaging a ceiling or wall when using the pike pole to make an opening in the ceiling or wall.

BRIEF DESCRIPTION OF THE DRAWINGS

Other objects, features, and advantages of the present invention will be apparent from the written description and the drawings in which:

FIG. 2 is a side elevation of the pike pole exerciser of FIG. 1 being used by an individual;

FIG. 4 is a partial perspective of a base pivot for the pike pole exerciser of FIGS. 1 and 2;

DETAILED DESCRIPTION OF THE PREFERRED EMBODIMENT

Figure 1:
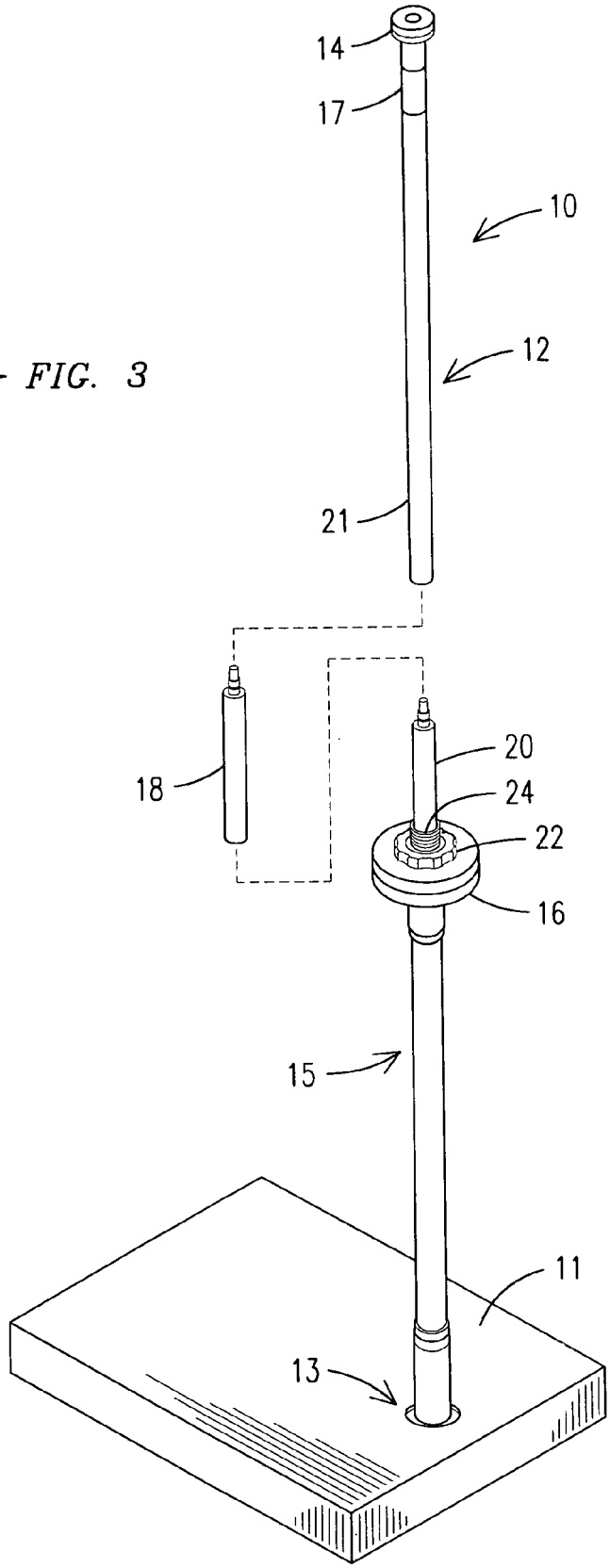
FIG. 1 is an exploded perspective of a pike pole exercise apparatus in accordance with the present invention.

A pike pole exercise apparatus 10 as shown in FIGS. 1 and 2 has a base 11 having a post 12 attached thereto with a swivel 13. The post 12 has a stop member 14 at one end thereof and has an elongated hollow slide member 15 sliding on the post 12. The slide member 15 has one or more barbell weights 16 removably attached thereto.

In FIG. 2, a person 19, such as a fireman, is shown using the pike pole exerciser while standing on the base 11 and gripping the elongated hollow slide member 15. The slide 15 has been raised on the post 12 to the stop 14. Weights 16 are attached to the slide member 15. The person 19 is exercising and training in the use of a pike pole hook into the ceiling.

Figure 5:
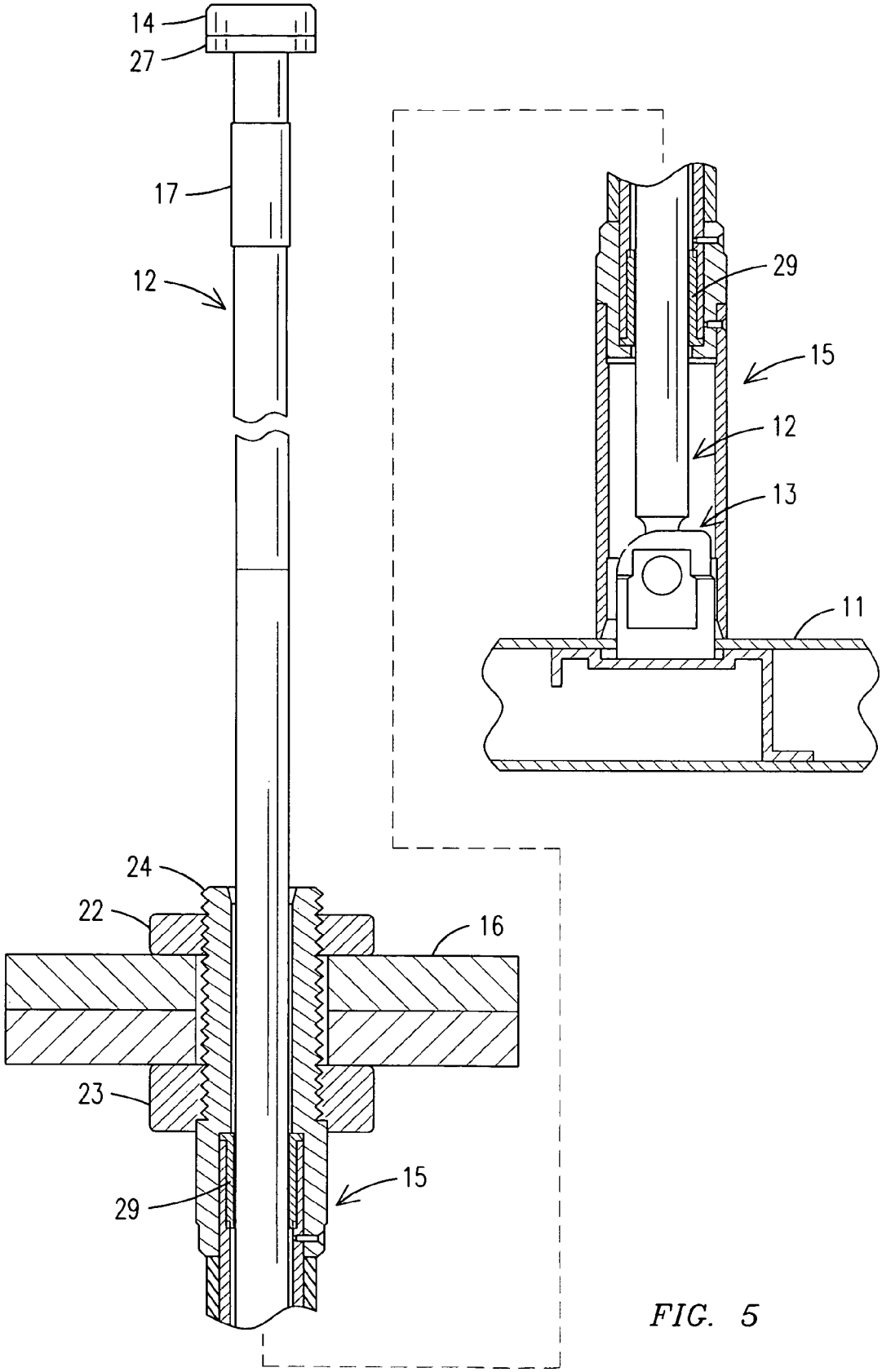
FIG. 5 is an exploded sectional view of the pike pole exerciser showing the operation of the slide member and of the base pivot.

As more clearly shown in FIG. 4, the post 12 can be tilted to practice ramming the pike post hook into a sidewall of a building. When a person is not using the pike pole exerciser 10, the hollow slide member 15 rests on the bottom of the post 12 supported on the base 11, as seen in FIG. 5. Resistance member 17 can be adjusted to place a frictional resistance on the elongated hollow slide member as it pushed upwards adjacent the stop 14. This simulates the ramming of the pike pole hook into a ceiling or wall.

Figure 3:
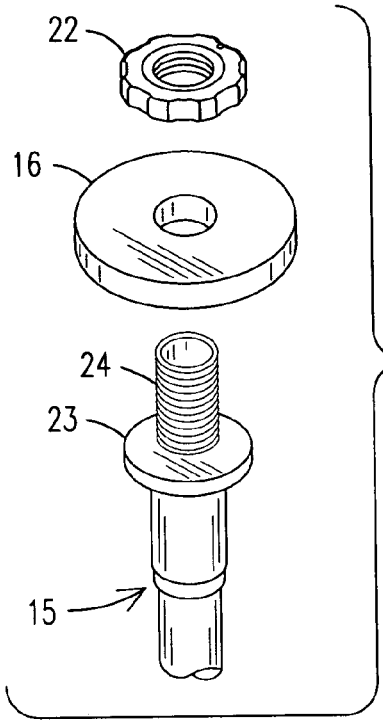
FIG. 3 is an exploded perspective view of a weight being added to the exerciser of FIGS. 1 and 2.

The hollow slide member 15 can have the barbell weight or weights 16 added to or removed by removing the post extension member 18 or post top 21 to separate the post bottom portion 20 and the post top portion 21. The nut 22 is threadedly removed to change the weights on the hollow slide member 15. The weights can be seen resting upon a weight support nut 23, seen in the exploded view of FIG. 3. Thus, the pike pole exerciser 10 can have the weights 16 adjusted to increase the resistance to the movement of the hollow slide 15 to increase the force required to move the slide 15 on the post 12.

The sectional view in FIG. 5 shows the base 11 having the swivel or pivot 13 supporting the post 12 and having upper and lower slide bearings 29. The hollow slide member 15 has the threaded portion 24 for attaching a weight support 23 having the weights 16 thereon and having the nut 22 to hold the weight 16 to the slide 15. This view also shows the resilient resistance member 17 adjacent the top 14.

Figure 6:
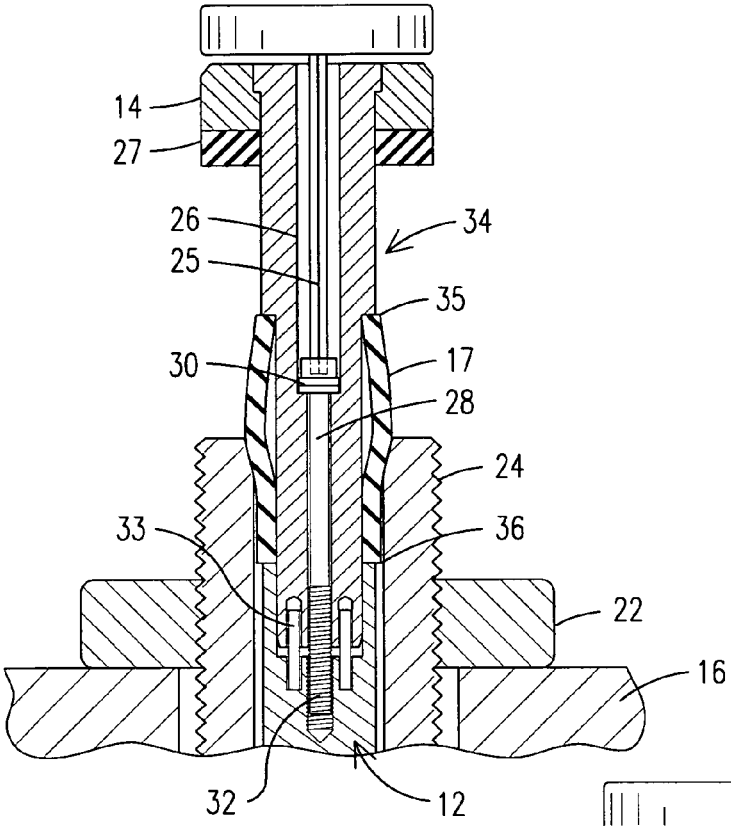
FIG. 6 is a sectional view of a pike pole exerciser resistance member having an allen wrench adjusting the resistance.
Figure 7:
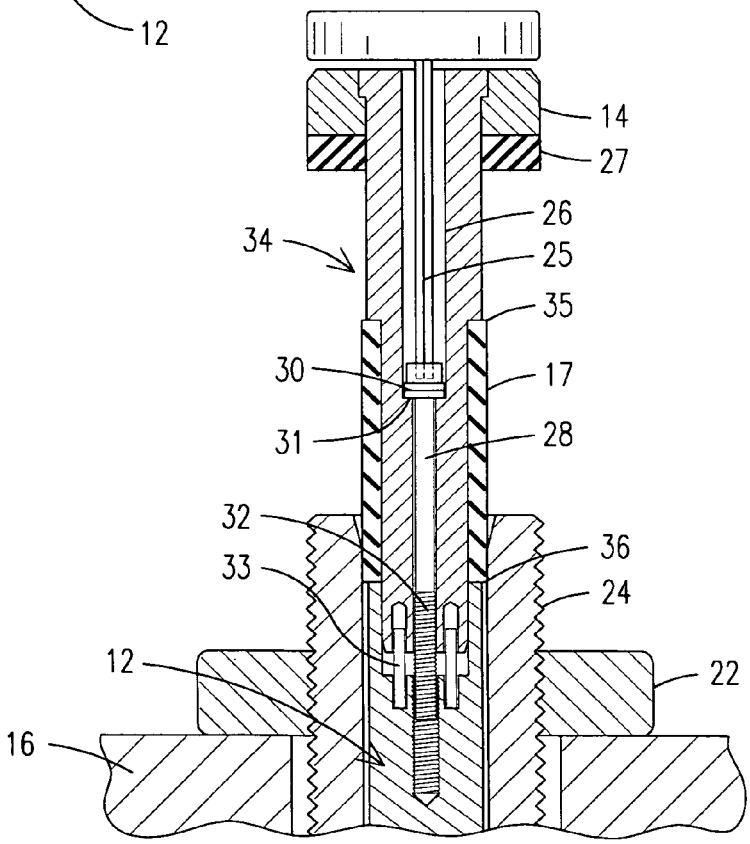
FIG. 7 is a sectional view of FIG. 6 showing the resistance member in a relaxed position.

In FIGS. 6 and 7, the sectional views which show the operation and adjustment of the resistance member 17. In FIG. 7, the resistant member is in a relaxed or rest position while in FIG. 6, the resistance member is being adjusted with an alien wrench 25, extending into an opening 26 in the post 12 adjacent the stop 14. Stop 14 has a bumper 27 to absorb the shock of the end of the slide member ramming thereagainst. An elongated bolt 28 is seen abutting washers 30 supported on a ledge 31. The alien wrench 25 is inserted therein for rotating the bolt 28. The bolt 28 has the threaded end 32 threaded into a solid portion of the rod 12 and has a pair of slide members 33 guiding the top 34 of the post 12. The resistance member 17 is shown abutting against ledges 35 and 36 on the post 12 so that when rotating the bolt 28 with the allen wrench 25, the resistance member 17 is compressed to expand to increase the resistance of the slide member 15. This simulates the pike pole hook ramming into a ceiling or wall of a building. When the bolt 28 is threaded the other way, it relaxes the resistance member 17, as shown in FIG. 7, to reduce the resistance. This allows the resistance of the slide member to be varied during the training and exercise of firemen in the use of a pike pole.

It should be clear at this time that a pike pole exerciser has been provided to allow firemen to both exercise and to practice in the use of pike pole hooks and to allow the resistance of the use of a pike pole to be varied to simulate the ramming of a pike pole hook into a ceiling or wall. However, the present invention is not to be construed as limited to the forms shown which are to be considered illustrated rather than restrictive.

I claim:

1. A pike pole exercise apparatus comprising: a base; an elongated post removably attached to said base and extending generally vertically therefrom, said elongated post having a stop member mounted on the top thereof and said elongated post having at least one removable post extension for varying the height of said elongated post; an elongated hollow slide member slidably mounted on said elongated post for sliding thereon, said elongated hollow slide member having a weight attached thereto; and a barbell weight removably attached to said elongated hollow slide member for increasing the weight thereof; whereby a fireman can grip the slide member and slide it up and down on said elongated pole to train and exercise in the use of a pike pole.

2. A pike pole exercise apparatus in accordance with claim 1 in which said elongated post has a hollow slide resting member located between the ends thereof for holding said elongated hollow slide member in a raised position on said elongated post.

3. A pike pole exercise apparatus in accordance with claim 1 in which said elongated post has two elongated post members removably attached together, one said elongated post member having a slide resting member thereon.

* * * * *